US010816167B1

(12) United States Patent
Peng

(10) Patent No.: US 10,816,167 B1
(45) Date of Patent: Oct. 27, 2020

(54) LAMP BULB SOCKET HAVING SWITCH WITH AXIALLY ROTATING ACTUATOR

(71) Applicant: Rich Brand Industries Ltd., Dongguan, Guangdong (CN)

(72) Inventor: Te-Shui Peng, Taoyuan (TW)

(73) Assignee: Rich Brand Industries Ltd., Dongguan, Guangdong (CN)

( * ) Notice: Subject to any disclaimer, the term of this patent is extended or adjusted under 35 U.S.C. 154(b) by 0 days.

(21) Appl. No.: 16/676,259

(22) Filed: Nov. 6, 2019

(30) Foreign Application Priority Data

Sep. 16, 2019 (CN) ..... 2019 1 0868936

(51) Int. Cl.

| | |
|---|---|
| ***H01R 33/955*** | (2006.01) |
| ***F21V 19/04*** | (2006.01) |
| ***H01R 33/96*** | (2006.01) |
| ***H01R 33/22*** | (2006.01) |

(52) U.S. Cl.
CPC ..... *F21V 19/04* (2013.01); *H01R 33/22* (2013.01); *H01R 33/962* (2013.01)

(58) Field of Classification Search
CPC ..... H01R 33/20; H01R 33/22; H01R 33/955; H01R 33/9555; F21V 19/0015; F21V 19/0025; F21V 23/04
See application file for complete search history.

(56) References Cited

U.S. PATENT DOCUMENTS

| | | | | | |
|---|---|---|---|---|---|
| 2,505,518 | A * | 4/1950 | Benander | H01R 33/9555 | 200/51.06 |
| 2,728,059 | A * | 12/1955 | Lagin | H01R 33/9555 | 439/424 |
| 2,799,743 | A * | 7/1957 | Popp | H01R 33/9555 | 200/51.03 |
| 4,283,107 | A * | 8/1981 | Anthony | H01R 33/22 | 200/51.17 |
| 6,227,912 | B1 * | 5/2001 | Hung | H01R 33/9555 | 200/51.17 |
| 6,396,009 | B1 * | 5/2002 | Yu | H01R 33/9555 | 200/51 R |
| 6,979,230 | B2 * | 12/2005 | Cherian | H01J 5/54 | 439/241 |
| 7,478,926 | B2 * | 1/2009 | Huang | F21V 23/0442 | 200/51.17 |

* cited by examiner

*Primary Examiner* — Ismael Negron
(74) *Attorney, Agent, or Firm* — Jen-Feng Lee, Esq.

(57) ABSTRACT

A lamp bulb socket includes an isolator seat with a connection port, an end cover coupled with the isolator seat and having a bracket with a hole, a connection guide terminal with a first contact arm, a connection terminal, a guide terminal with a second contact arm, and a turn switch having a rod with gripping grooves at a first end and four arc notches at a second end opposite the first end. The arc notches received in the end cover and the first end held on the hold of the bracket. The turn switch further includes a terminal contact coupled to the four arc notches such that, when the rod is turned, the terminal contact opens or closes a connection between the connection terminal and guide terminal.

9 Claims, 5 Drawing Sheets

LAMP BULB SOCKET HAVING SWITCH WITH AXIALLY ROTATING ACTUATOR

CLAIM OF FOREIGN PRIORITY, 35 U.S.C. § 119

The present invention claims its foreign priority filing, pursuant to the provision of 35 U.S.C. section 119 et seq, based upon the application filed by the same inventor in China, having application number 201910868936.9 filed on Sep. 16, 2019.

FIELD AND BACKGROUND OF THE INVENTION

Light sockets have been around for a long time. The light sockets of existing art and prior art generally consist of the main components put together in the structure briefly, described herein:

An isolator seat will be matched to an end capping containing contact terminals for connection with two electrical wires. A separate on-off switch control mechanism is imbedded into the isolator seat, and the on-off switch mechanism contains coil springs to provide a biasing force and has an out-extending knob, extending out of the isolator seat, to provide a rotational movement to allow turning by human hands/fingers.

Because the separate on-off switch mechanism has its internal complexities and different ways of being installed/embedded into the space within the isolator seat and the end capping, a substantial amount of components are being used, which necessarily added to the number of assembly steps and complexities.

The control for establishing electrical connection, and dis-engaging the electrical connection, implemented on the prior art products goes through at least seven (7) contact points in the current art light sockets. This translated into higher costs and less reliability of the end products.

As will be made clear in the remaining part of this application, the present invention provides for a simplified design where the electrical connection is more "built-in", using fewer amount of parts, and will result in lower production costs and higher product reliability.

SUMMARY OF THE INVENTION

The invention relates to a light socket with fewer connection parts and more straightforward electrical connection mechanism that results in more reliable electrical connection between the power source to the lighting unit, as well as lower production costs due to lesser amount of total components used.

The implementation of present invention is primarily composed of an isolator seat, which further has a seat bracket, an end cover on top of the isolator seat, a connection guide terminal further having a first contact arm, a connection terminal, a guide terminal further having a second contact arm, a turn switch, and a connection port.

The first contact arm and the second contact arm are set inside said connection port; the turn switch further has a turn rod placed through a hole on the seat bracket, said turn rod has gripping grooves; said turn switch controls a terminal contact regarding its contact with connection terminal and the guide terminal to form electrical connection and said turn rod protrudes through the end cover.

The first contact arm (of the connection guide terminal) and the second contact arm (of the guide terminal) are placed into the connection port inside the isolator seat. The connection guide terminal and the connection terminal will be used to connect the positive and negative power lines, so that the turn rod will be held, by human hand for example, to turn and control the terminal contact, establishing or disconnecting, the electronical contact between connection terminal and guide terminal.

In other words, the contact points to provide electrical power connection and delivery are implemented by connection guide terminal, connection terminal, guide terminal and the turn switch only, making the electrical connection simpler than the current art structures.

By such implementation, the amount of overall parts used in a light socket is reduced and the structure is simplified, enhancing the assembly efficiency at production time.

The terminal contact further has a spring arm that is in contact with the isolator seat and produces an upward biasing force for the turn rod. As shown in FIGS. 6 and 7, two spring arms (symmetrically formed) can also work, though a single spring arm would be sufficient.

The electrical connection is established by turning/controlling the terminal contact within the structure as disclosed herein. The terminal contact further has a first main capping, a first contact face and second contact face that are evenly and symmetrically formed with gaps between first and second contact faces.

The turn rod has four surrounding arc notches which serve to engage or disengage electrical power to the light socket as will be more fully in the detailed description portion.

DESCRIPTION OF THE DRAWINGS

The accompanying drawings exemplify the preferred embodiments of the invention. Together with the description, serve to explain the principles of the invention.

A brief description of the drawings is as follows.

DETAILED DESCRIPTION OF THE PREFERRED EMBODIMENT

Figure 1:
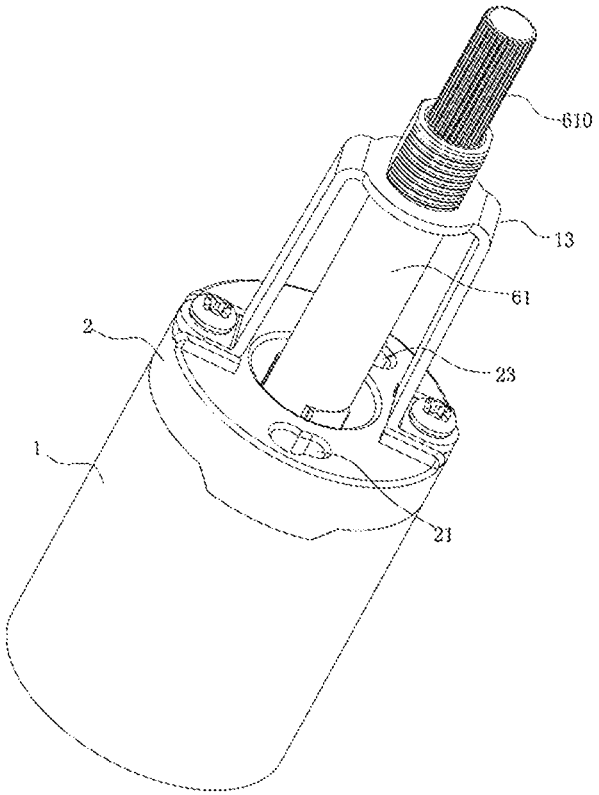
FIG. 1 is the perspective view of the socket of the present invention.

FIGS. 1-9, including certain exploded views, serve to explain the preferred embodiments of the present application.

The implementation of present invention is primarily composed of an isolator seat 1 where an end cover 2 is on top of the isolator seat 1. The end cover 2 has a seat bracket 13 with a hole. A turn switch 6 is the primary control mechanism to establish electrical connection.

Three contact points exist on the isolator seat: a connection guide terminal 3, a connection terminal 4, and a guide terminal 5.

The connection guide terminal 3 further has a first contact arm 31; the guide terminal 5 further has a second contact arm 51.

The first contact arm 31 and the second contact arm 51 are set inside a connection port 11. The turn switch 6 further has a turn rod 61 placed through a hole on the seat bracket 13, said turn rod 61 has gripping grooves 610; said turn switch 6 controls a terminal contact 62 as to its contact with connection terminal 4 and the guide terminal 5 to form electrical connection.

Said turn rod 61 protrudes through the end cover 2.

Figure 2:
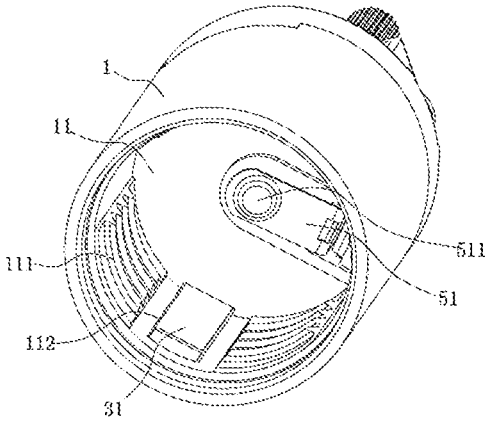
FIG. 2 shows the inside view of the isolator seat.
Figure 3:
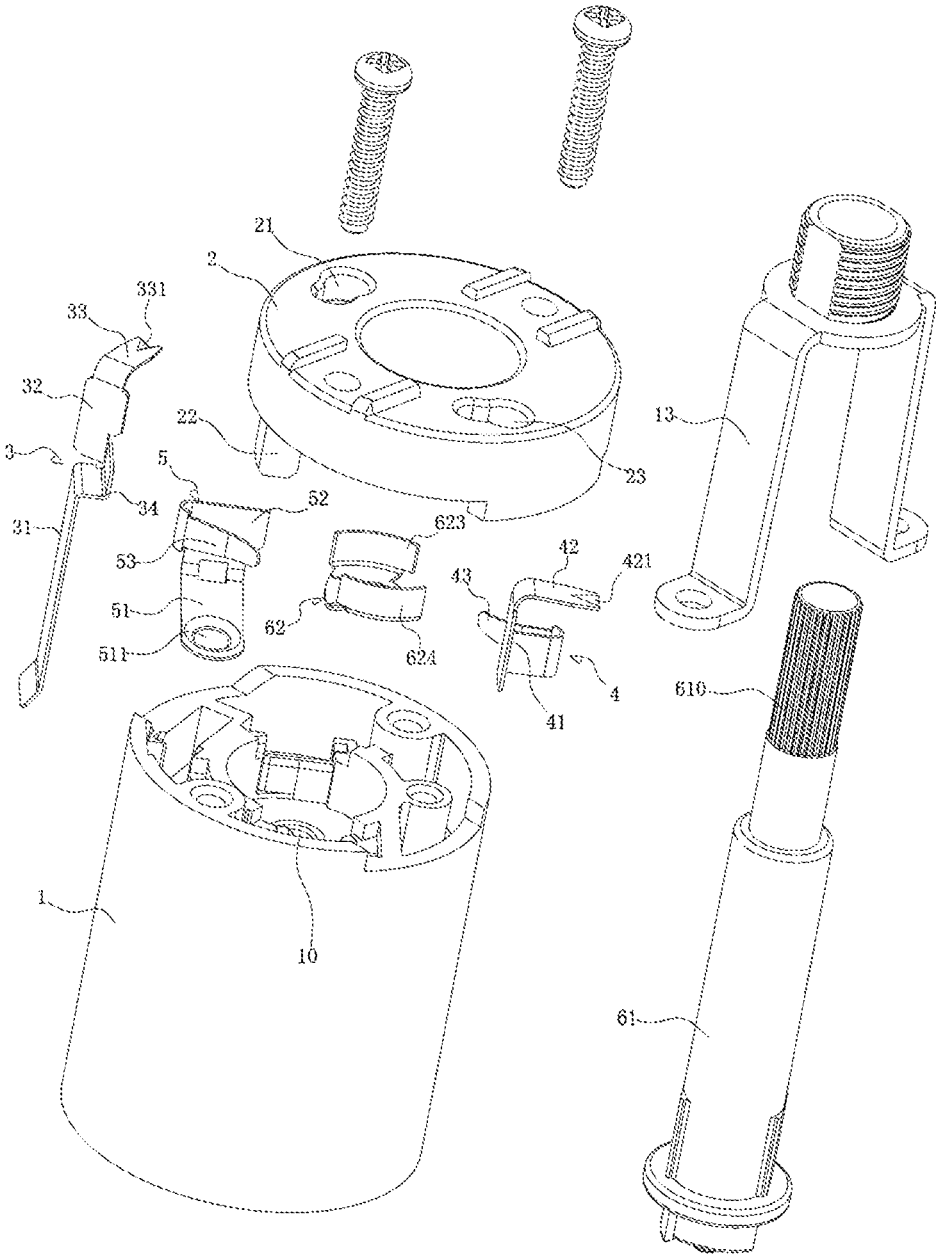
FIG. 3 is the exploded view for the various parts of the present invention introduced herein.

These are shown in FIGS. 1-3.

The first contact arm 31 (of the connection guide terminal 3) and the second contact arm 51 (of the guide terminal 5) are placed into the connection port 11 inside the isolator seat 11. The connection guide terminal 3 and the connection terminal 4 will be used to connect the positive and negative power lines, so that the turn rod 61 will be used, by human hand for example, to turn and control the terminal contact 62, establishing, or disconnecting, the electronical contact between connection terminal 4 and guide terminal 5.

By such implementation, the amount of overall parts used in a light socket is reduced and the structure is simplified, enhancing the assembly efficiency at production time.

Figure 6:
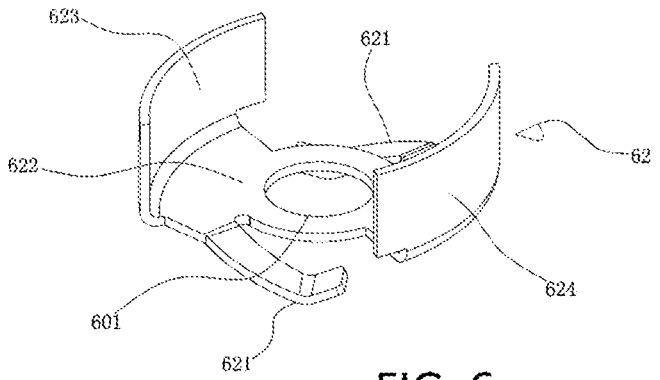
FIG. 6 illustrates the terminal contact.
Figure 7:
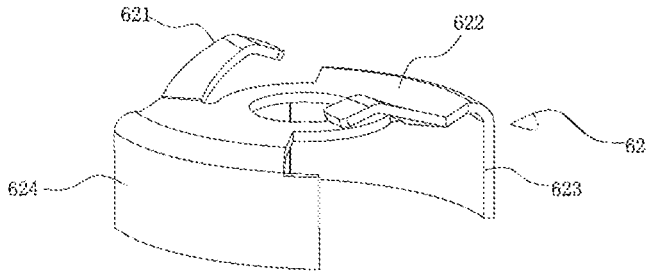
FIG. 7 is the reversed view of the terminal contact of FIG. 6.

The terminal contact 62 further has a spring arm 621 that is in contact with the isolator seat 1 and produces an upward biasing force for the turn rod 61. The biasing force generated by the spring arm creates a slight friction between turn rod 61 and the isolator seat 1, and provides the user with a feed-back sensation when turning a switch. As shown in FIGS. 6 and 7, two spring arms 621 (symmetrically formed) can also work, though a single spring arm 621 would be sufficient.

Figure 4:
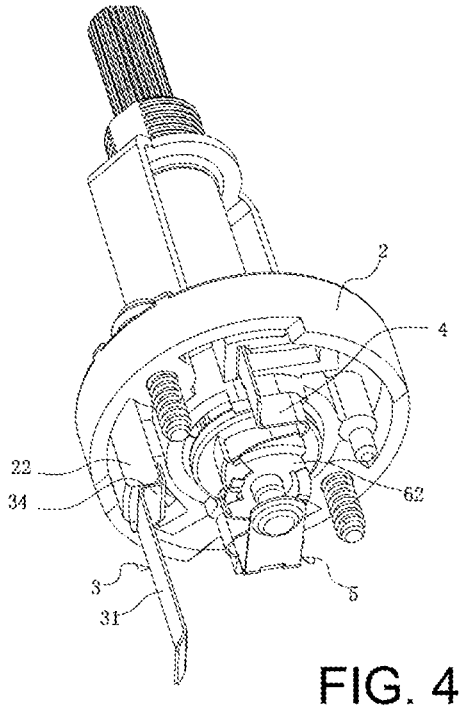
FIG. 4 shows the view with parts and components assembled on the end cover.
Figure 5:
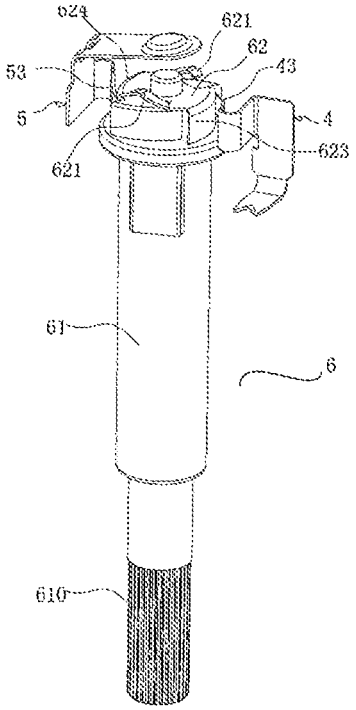
FIG. 5 shows the view with parts and components assembled on the turn rod.

FIGS. 4 and 5 show how the electrical connection is established by turning/controlling the terminal contact 62 within the structure as disclosed herein. The terminal contact 62 further has a first main capping 622, a first contact face 623 and second contact face 624 that are evenly and symmetrically formed with gaps between first and second contact faces 623/624.

The position and angle of the first contact face 623 and second contact face 624, relative to the spring arm 621, are more clearly shown in FIGS. 6 and 7. Spring arm 621 makes contact with the isolator seat 1 and creates a friction force so give the turning sensation when the turn rod 61 is being operated, by a human hand for example.

Figure 8:
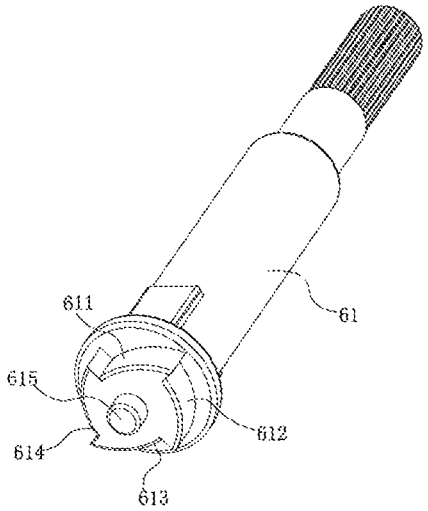
FIG. 8 shows the turn rod with four surrounding arc notches and the guide post.
Figure 9:
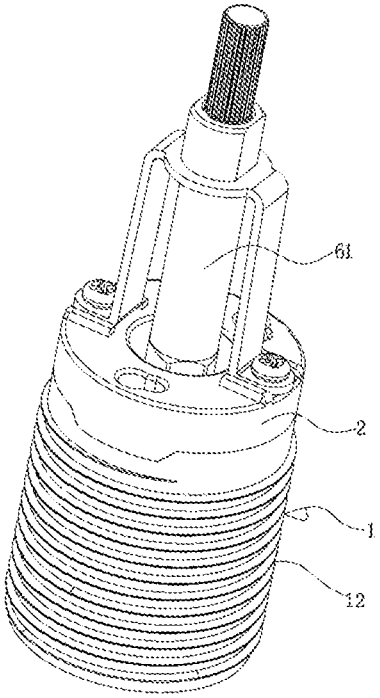
FIG. 9 shows another embodiment of present invention with outside thread lines on the isolator seat and an unthreaded seat bracket.

Reference FIG. 8; the turn rod 61 further has 4 surrounding arc notches of first arc notch 611, second arc notch 612, third arc notch 613 and fourth arc notch 614. The first contact face 623 and the second contact face 624 are initially aligned to the first act notch 611 and the third arc notch 613.

The first main capping 622 further has a guide hole 601 that receives a guide post 615 that is formed at a distal end of the 4 surrounding arc notches of the turn rod 61. The guide hole 601 ensures the terminal contact 62's stability in turning.

The connection guide terminal 3 has a second main segment 32 with an up-extending bent-shaped first wire contact 33 and a down-extending bent-shaped first bending segment 34. A v-shaped first wire notch 331 is formed at the end of first wire contact 33 that is aligned to a first wire hole 21 on the end cover 2.

The metal core portion of an electrical wire can be inserted through first wire hole 21, the first wire notch 331 of the first wire contact 33 will press down on the metal core portion of the electrical wire to establish the electrical connection firmly. This "insert to establish connection" working mode is simpler than the current art products.

A support tab 22 is formed on the end cover 2; said support tab 22 is in contact with the first bending segment 34.

The connection terminal 4 is further comprised of a third main segment 41, a second wire contact 42 on upper portion of the third main segment 41, and a first arc arm 43 on a side of the third main segment 41 for contacting the terminal contact 62. A v-shaped second wire notch 421 is formed at an end of the second wire contact 42 that is aligned to a second wire hole 23 on the end cover 2.

The metal core portion of an electrical wire can be inserted through second wire hole 23; the second wire notch 421 of the second wire contact 42 will press down on the metal core portion of the electrical wire to establish the electrical connection firmly. This "insert to establish connection" working mode is simpler than the current art products.

The guide terminal 5 is further comprised of a fourth main segment 52, second arc arm 53 on a side of the guide terminal 5 for contacting the terminal contact 62; the second contact arm 51 has a contact nob 511 at a distal end.

The connection port 11 further has inside thread lines 111 and a terminal port 112 for receiving the first contact arm 31; the isolator seat 1 further has outside thread lines 12.

As disclosed herein, to operate a light socket as taught in by present application, a user s the turn rod 61, to get the terminal contact 62 to establish electrical connection terminal 4 and guide terminal 5. When turn rod 61 is further turned; the terminal contact 62 can be rotated to break the electrical connection between connection terminal 4 and guide terminal 5.

The disclosure herein set forth certain specific embodiments of the present invention. The scope of the invention, however; is not limited by the specific embodiments herein. Equivalent structures, albeit not expressly discussed, would be within the scope of present invention as can be understood by people with reasonable and comparable skills.

The invention claimed is:

1. A light socket comprising:

an isolator seat;

an end cover provided on top of the isolator seat, and having a seat bracket with a hole;

a connection guide terminal having a first contact arm;

a connection terminal;

a guide terminal having a second contact arm; and a turn switch having a turn rod with gripping grooves at a first end, and a terminal contact coupled at a second end opposite the first end, wherein the first contact arm and the second contact arm extend inside a connection port, the first end of the turn rod extends through the hole on the seat bracket, the second end extends into the end cover, and said turn switch controls the terminal contact such that it selectively contacts the connection terminal and the guide terminal to form electrical connection.

2. The light socket of claim 1, wherein the terminal contact further has a spring arm that is in contact with the isolator seat and produces an upward biasing force for the turn rod.

3. The light socket of claim 2, wherein said terminal contact further has a first main capping, and first contact face and second contact face that are symmetrically formed with gaps between first and second contact faces, and wherein said turn rod further has four surrounding arc notches consisting of first arc notch, second arc notch, third arc notch and fourth arc notch, and wherein the first contact face and the second contact face are initially aligned to the first act notch and the third arc notch.

4. The light socket of claim 3, wherein the first main capping further has a guid hole that receives a guide post, said guide post is formed at a distal end of the four surrounding arc notches of the turn rod.

5. The light socket of claim 4, wherein the connection guide terminal has a second main segment with an up-extending bent-shaped first wire contact and a down-extending bent-shaped first bending segment, wherein a v-shaped first wire notch is formed at the end of first wire contact that is aligned to a first wire hole on the end cover.

6. The light socket of claim 5 further comprising a support tab formed on the end cover, said support tab is in contact with the first bending segment.

7. The light socket of claim 6, wherein the connection terminal 4 is further comprised of a third main segment, a second wire contact on upper portion of the third main segment, and a first arc arm on a side of the third main segment for contacting the terminal contact, and wherein a v-shaped second wire notch is formed at an end of the second wire contact that is aligned to a second wire hole on the end cover.

8. The light socket of claim 6, wherein the guide terminal is further comprised of a fourth main segment, second arc arm on a side of the guide terminal for contacting the terminal contact, and wherein the second contact arm has a contact nob at a distal end.

9. The light socket of claim 6, wherein said connection port is further comprise of inside thread lines and a terminal port for receiving the first contact arm, and wherein the isolator seat further has outside thread lines.

* * * * *